US005464451A

United States Patent [19]

Denny et al.

[11] Patent Number: 5,464,451

[45] Date of Patent: Nov. 7, 1995

[54] RE-TANNING PROCESS

[75] Inventors: Jacques P. Denny; Josep R. Sorolla, both of Barcelona, Spain

[73] Assignees: Sandoz Ltd., Basel, Switzerland; Muenzing Chemie GmbH, Heilbronn, Germany

[21] Appl. No.: 197,901

[22] Filed: Feb. 17, 1994

[30] Foreign Application Priority Data

Feb. 18, 1993 [DE] Germany ..... 43 05 019.0

[51] Int. Cl.[6] ..... C14C 3/18

[52] U.S. Cl. ..... 8/94.21; 8/94.18; 8/94.22; 8/94.33; 8/94.26; 252/8.57; 427/389

[58] Field of Search ..... 8/94.18, 94.21, 8/94.22, 94.23, 94.33, 94.26, 94.27; 252/8.57; 427/389

[56] References Cited

U.S. PATENT DOCUMENTS

| | | | |
|---|---|---|---|
| 4,596,581 | 6/1986 | Hohr | 8/94.21 |
| 4,750,906 | 6/1988 | Schmidt | 8/94.18 |

FOREIGN PATENT DOCUMENTS

| | | |
|---|---|---|
| 3005699A1 | 8/1981 | Germany . |
| 3005699 | 8/1981 | Germany . |
| 3201226 | 7/1983 | Germany . |
| 3406912 | 10/1989 | Germany . |
| 2259713 | 3/1993 | United Kingdom . |

OTHER PUBLICATIONS

Ullman's Encyclopedia of Industrial Chemistry, vol. A15, (1990), pp. 274–277. (month Unknown).

Thorstensen, "Practical Leather Technology", Robert E. Krieger Publishing Co., N.Y., (1976), pp. 231–237. (month Unknown).

Ullman's Encyclopedia of Industrial Chemistry, vol. A15, (1990), pp. 275–278. (month Unknown).

Chem. Abs. 95:134405f "Neutralization of Mineral–tanned leather", vol. 95, p. 80, Aug. 1981.

Derwent Abstract, of DE 3005699 A1 (English–language), Aug. 1981.

*International Dictionary of the Leather and Allied Trades,* Walter Freudenberg; Springer–Verlag, (New York) 1968; {cover page, {cover page, one index pages for the German–language letter "A", one index page for the English–language letter 'S', and a page from section #35} (Month unknown).

*Leather Technician's Handbook,* J. H. Sharphouse; Leather Producers' Association, (9 St. Thomas Street, London SE1); {cover page, pp. 167–168} (Date Unknown).

*Primary Examiner*—Prince Willis, Jr.
*Assistant Examiner*—Alan D. Diamond
*Attorney, Agent, or Firm*—Robert S. Honor; Carl W. Battle; Michael P. Morris

[57] ABSTRACT

A process for the re-tanning of tanned leather or pelt, wherein the tanned leather pelt is re-tanned with (A) a polymeric carboxylic acid, containing α-hydroxy-acrylic units as constituent units of the polymer, optionally in salt form with the proviso that for this re-tanning (A) is not employed immediately after a mineral tanning, immediately before a mineral re-tanning or after a mineral re-tanning and also not in a direct connection with a mineral after-treatment.

12 Claims, No Drawings

RE-TANNING PROCESS

German laid-open patent application DE 42 27 778 A1 [i.e. German Patent Application P 42 27 778.7 published as DE 42 27 778 A1 on 25th Feb. 1993 and corresponding to U.S. patent application Ser. No. 932,479 filed on 20th Aug. 1992] discloses a process for the production of mineral tanned and/or re-tanned and/or after-treated leather, wherein certain polymeric compounds (A) are employed in such a way and in such a sequence to a mineral treatment that the mineral yield and efficiency may be increased to a surprisingly high degree.

It has now surprisingly been found that the polymers (A) are very well suitable as re-tanning agents, even without a direct process connection with a mineral treatment of the substrate and, in particular, without the use of a mineral re-tanning, and that they favourably influence not only the penetration-dyeing of the leather, but lead also to dyeings of high levelness and purer shade.

The invention thus relates to a process for the re-tanning of tanned leather or pelts, wherein the tanned leather or pelt is re-tanned with (A) a polymeric carboxylic acid, containing α-hydroxyacrylic units as constituent units of the polymer, optionally in salt form, with the proviso that for this re-tanning (A) is not employed immediately after a mineral tanning, immediately before a mineral re-tanning or after a mineral re-tanning and also not in a direct connection with a mineral after-treatment.

As polymeric carboxylic acids (A) or their salts come principally into consideration (co)poly-α-hydroxyacrylic acids, optionally further containing non-ionic and/or other anionic co-monomeric units as constituents of the polymer or their salts. The other anionic co-monomeric units—indicated in the free acid form—are advantageously derivatives of ethylenically unsaturated monomeric carboxylic acids (principally of aliphatic $C_{3-5}$-carboxylic acids), in particular (meth)acrylic acid, crotonic acid, maleic acid, itaconic acid, aconitic acid and citraconic acid, among which maleic acid and (meth)acrylic acid are preferred, especially acrylic acid. As non-ionic monomeric units come principally into consideration the derivatives of (meth)acrylamide, (meth)acrylonitrile and/or vinylmethylether. Copolymers comprising α-hydroxyacrylic acid units and acrylic acid units and/or their salts or, in particular, consisting thereof are preferred. As "derivatives" of the monomers are meant here monomer units deriving from the copolymerisation of the mentioned monomers.

The numerical average molecular weight $\overline{M}_N$ of the polymers (A) is advantageously in the range of 500 to 100,000, preferably 600 to 30,000. Of the polymers to be employed are furthermore preferred those whose weight average molecular weight $\overline{M}_W$ is in the range of 1000 to 500,000, preferably 1000 to 250,000. The indicated molecular weights are intended in the form of the sodium salts of the polymeric acids.

The proportion of α-hydroxyacrylic acid units (in particular as sodium salt) may range up to 100 mol % of the polymer, advantageously it is in the range of 5 to 70 mol %, preferably <50 mol %, more preferably in the range of 10 to 50 mol %, especially 10 to 30 mol %, of the polymer.

The polymers (A) to be employed according to the invention, may be produced in a manner known per se, e.g. according to the method described in Swiss Patent 669 952 or GB-Patent Nr. 1 524 013, the content of which is incorporated herein by reference.

Advantageously the polymers (A) are produced using as starting monomer an α-halogenacrylic acid, preferably α-chloroacrylic acid, in the form of the free acid or of a hydrosoluble salt, in particular an alkali metal salt (e.g. lithium, sodium or potassium salt) or/and ammonium salt, and optionally further monomers as indicated above, the other anionic monomers being also employed in the form of the free acids or of hydrosoluble salts thereof, advantageously alkali metal or/and ammonium salts. The polymerisation takes place advantageously in aqueous medium, under acidic conditions, at elevated temperatures e.g. at temperatures between 50° and 150° C., preferably in the range of 80° to 105° C., suitably in the presence of a polymerisation catalyst, which advantageously is a peroxycompound or a mixture of peroxycompounds, preferably hydrogenperoxide or/and potassium peroxydisulphate, and optionally also in the presence of a polymerization regulator (chain transfer catalyst), e.g. thioglycolic acid. The catalyst is suitably employed in an efficient amount, e.g. in the range of 0.001 to 0.5 mole, preferably 0.01 to 0.35 moles of catalyst per mole of monomers.

After the acidic polymerisation the polymers are advantageously converted to the corresponding salt form by reaction with a base. There may be employed for instance alkali metal hydroxides (NaOH, LiOH, KOH) or ammonia, among which alkali metal hydroxides are preferred, especially sodium hydroxide.

Any kinds of leather as are conventionally employed for a re-tanning from aqueous medium may be employed in the process of the invention, e.g. grain leather (such as nappa from sheep, goat or cow and box-leather from calf or cow), suede-leather (such as velours from calf-leather, sheepskin and goatskin and also hunting leather), split-leather (e.g. from cow, pig and optionally also calf-skin), buffalo-leather, buck-skin and nubuk-leather; further also wooled skins and furs (e.g. for shearling suede). The leathers may have been tanned by any conventional tanning method, e.g. vegetable mineral, synthetic or combined tanned (e.g. chrome-tanned, zirkonyl-tanned, aluminium-tanned or semichrome-tanned).

The leathers may be of various thicknesses. There may be employed very thin leathers, such as book-binders leather or glove-leather (nappa), leather of medium thickness, such as shoe-upper leather, garment leather and leather for handbags, or also thick-leathers, such as upholstery leather, leather for suit-cases, for belts and for sport articles; woolled skins and furs may also be employed.

After tanning and before the re-tanning process of the invention, the pH of the leather may advantageously be set to values in the range of 4 to 8 (the leather is "neutralized"). Depending on the kind of the leather, there may be chosen an optimum pH-range, e.g. for grain-leather pH-values in the range of 4 to 7, preferably 5 to 6.5, for suede-leather and split velours and for very thin leathers pH-values in the range of 4.5 to 7, while for intermediately dried suede leathers and intermediately dried split-velours the pH may range in the scope of 5 to 7. For the adjustment of the pH-value of the leather there may be employed conventional assistants: for tanned leather of acidic character, the pH may be adjusted by addition of suitable bases, e.g. by addition of ammonium bicarbonate or of alkali metal salts of weak acids, e.g. sodium formate, sodium acetate, sodium carbonate, sodium bicarbonate or sodium sulphite, among which sodium formate and sodium bicarbonate are preferred. Sodium carbonate and sodium bicarbonate may advantageously be employed in particular as secondary bases for the exact adjustment of the superficial pH-value of the leather. Mineral tanned leather may, if desired, also be masked, e.g. with alkali metal formate, oxalate or polyphosphate.

The re-tanning of the invention with the re-tanning agents (A) is carried out expedientely in aqueous medium and may take place under re-tanning conditions (in particular temperature, pH-value and concentration) conventional per se, advantageously at temperatures in the range of 10° to 70° C., preferably 20° to 60° C., and at pH-values of advantageously 4 to 8, preferably 4.5 to 7.5. The adjustment of the pH-value is advantageously carried out for so long until in the liquor and in the cross-section there is achieved an equilibrium in the mentioned pH-range. The concentration of the re-tanning agent (A), referred to wet substrate, is advantageously in the range of 0.04 to 4% by weight, preferably in the range of 0.1 to 1.5% by weight. The duration of the re-tanning treatment with (A) may vary, depending on the substrate, the apparatus, the treatment parameters and the kind of (A); in general, it ranges, advantageously in the scope of 20 minutes to 2½ hours, preferably in the scope of 30 minutes to 2 hours.

The re-tanning of the invention with (A) is carried out in such a way that it does not take place directly after a mineral tanning and also not directly before a mineral re-tanning as well as also not after a mineral re-tanning; in particular, the re-tanning agents (A) to be employed according to the invention are not combined with mineral tanning agents. If desired, the polymers (A) to be employed according to the invention may however be blended with vegetable or synthetic re-tanning agents or may be combined in a multistep re-tanning with vegetable or/and synthetic re-tanning agents. If the polymers (A) are blended or mixed with other re-tanning agents, the polymers (A) amount advantageously to at least 50% by weight of the re-tanning agent mixture, preferably to at least 80% by weight.

As vegetable and synthetic re-tanning agents, that may be combined in a one-step or multi-step re-tanning process with the polymeric re-tanning agents (A), are suitable any desired of these re-tanning agent [e.g. quebracho, chestnut or mimosa extracts, aromatic syntans, polyurethanes (meth-)acrylic acid based (co)polymers or melamine/-, dicyanodiamide/- and/or urea/formaldehyde resins].

With particular advantage the polymers (A) employed for the re-tanning of the invention are not mixed or blended with any other re-tanning agents.

The leathers re-tanned according to the invention may be dyed in a manner known per se with dyestuffs suitable for the dyeing of leather. As dyes come principally into consideration anionic or also non-ionic dyes that are sufficiently hydrosoluble in order to be employed for the dyeing of leather from aqueous medium and that, in particular, contain at least one hydrosolubilizing sulphonic acid or carboxylic acid group, optionally in salt form, or/and at least one hydrosolubilizing sulphonamide group, or also metal complexes or reduced sulphur dyes that are otherwise sufficiently hydrosoluble. The dyeing may take place in the same bath or also in a fresh bath and may be carried out under conditions conventional per se, principally at temperatures in the range of 20 to 80, preferably 25 to 60° C. The pH-values of the dye bath may range in broad scopes, principally from pH 8 to pH 3; in general it is of advantage to start the dyeing at higher pH-values and to conclude it at lower pH-values. Preferably dyeing is carried out at pH-values $\geqq 4$, in particular in the pH-range of 8 to 4, and for the conclusion of the dyeing procedure the pH-value is advantageously lowered (e.g. by addition of an acid conventional in leather dyeing, in particular acetic acid or formic acid), preferably to values in the range between 4 and 3. The dyeing may optionally be carried out in the presence of conventional dyeing assistants, e.g. of build-up assistants of preferential dyestuff affinity (e.g. highly oxyethylated and optionally quaternized fatty amines or fatty-amino-alkylamines).

The leathers or pelts may, if desired, be fatted before and/or after the dyeing; if desired a fat-liquor may also be employed before, simultaneously with or/and after the treatment with (A) and before the dyeing. Any known fat-liquors, as otherwise conventionally employed from aqueous medium for the fatting of leather, are suitable, in particular animal, vegetable or mineral fats, oils or waxes or chemically modified animal or vegetable fats or oils or further synthetic leather-fatting agents. The following may be mentioned as examples: tallow, fish oil, neats-foot oil, olive oil, castor oil, rape-seed oil, cottonseed oil, sesame oil, corn oil and japanese tallow and chemically modified products thereof (e.g. hydrolysis, transesterification, oxydation, hydrogenation or sulphonation products), bees wax, chinese wax, carnauba wax, montan wax, wool fat, birch oil, mineral oil with boiling range between 300° and 370° C. (especially the so-called "heavy alkylates"), soft-paraffin, medium- paraffin, vaseline, methylesters of $C_{14-22}$-fatty acids and esters, in particular partial esters, of polybasic acids (e.g. phosphoric acid) with optionally oxyethylated fatty alcohols. For fat-liquoring there are preferably employed aqueous fat-liquor emulsions, in which the fat-liquor is emulsifyed with the aid of an emulsifyer and/or by chemical modification. For the use before dyeing there are preferred as fat-liquors, oils and their chemical modification products; the phosphoric acid esters and fatting agents of non-oily character but rather of waxy character are advantageously employed only after the dyeing. By the term "sulphonation" for the fatting agents, there is meant, generally, the introduction of the sulpho group, including also the formation of a sulphato group (="sulphating") and the introduction of a sulpho group by reaction with a sulphite or $SO_2$ (="sulphiting").

For fatting after the dyeing procedure the fatting agent is advantageously added before the pH-value of the liquor is lowered, preferably to values in the range of 3 to 4.

The dye-concentration may vary in any desired ranges, as are required for the desired colouristic effects. Since according to the invention there may be obtained leathers dyed in good penetration and high purity of shades, there may be achieved dyeings of from very light pastel shades up to very deep dyeings; depending on the employed dye the respective dye concentrations may vary; in general, the dyes may be employed in concentrations ranging up to the saturation limit of the substrate, e.g. up to 10% referred to the wet weight of the substrate. The dyeing may be carried out in one or more steps, e.g. in two steps, optionally with intermediate charge-reversal of the substrate with conventional cationic assistants and/or optionally further re-tanning. There may also be employed mixtures of compatible dyes, e.g. also trichromatic dye-mixtures.

A conventional leather softener, in particular a cationic leather softener, may, if desired, be applied in a final step, particularly if fatting has been carried out with a sulphonated fat-liquoring agent.

The so-treated substrates may then be further treated in conentional manner, e.g. rinsed or/and washed, drained, dried and set out. If desired, the so-treated leathers or pelts may be finished with conventional leather-finishing agents.

By the re-tanning process of the invention, there may be achieved very well and regularly re-tanned leathers and pelts, in particular leathers of excellent fineness and firmness of the grain. By the subsequent dyeing, especially with anionic dyes, there may be achieved very well penetration-dyed leathers and pelts, in which the dyeings distinguish by their high levelness and purity of shade, while the dyeing properties, in particular the fastnesses, are of optimum level as corresponding to the employed dyes. There may e.g. be produced finely dyed suede-leathers and grained leather, in which a subsequent buffing of the dyed substrate is readily possible. There may, in particular, be produced also strong, hard-wearing, dyed leathers (e.g. upholstery leathers, leathers for suitcases or leathers for sport articles), which are so well penetration dyed, that superficial damages of the dyed leathers, that may occasionally occur during use, e.g. scoured or torne places are colouristically not evidenced since they are practically equal in shade as the remaining surface.

In the following examples the percentages are by weight and refer to the sammed weight of the substrate, if there is not unequivocally meant another concentration, such as e.g. in Example 6 the basicity of the chromium sulphate; the temperatures are indicated in degrees Celsius, the dyes are employed in commercial blended form; their concentrations are indicated in percent of pure dye, referred to the substrate. "C.I." stands for "Colour Index".

EXAMPLE 1

Sammed, chrome-tanned cow-leather (wet-blue 0.8 mm) is washed with 200% of water at 35° C. during 15 minutes and then the bath is drained off. In a fresh bath of 200% of water at 35° C. the leather is treated first with sodium formate and then with sodium bicarbonate until an equilibrium-pH between 5 and 6.5 in the cross-section and in the liquor is achieved. The bath is drained-off and the leather is washed during 15 minutes with 200% of water at 35° C. and then the bath is drained-off. In a new bath of 100% of water and 50° C. the leather is re-tanned during one hour with 1% of Product (1) according to Example 1 of German Patent Application P 42 27 778.7 [which is a 19.36% aqueous solution of the sodium salt of an acrylic acid (7)/α-hydroxyacrylic acid (3) copolymer, (molecular weights of the copolymer: $\overline{M}_N$=2.07.10$^4$, $\overline{M}_W$=2.09.10$^5$)]. Then the bath is drained off and the leather is dyed in a fresh bath of 100% of water at 50° C. and 1% of C.I. Acid Brown 359 during 60 minutes, then 0.2% of formic acid are added and drumming is continued for 30 minutes. Then the bath is drained-off and the leather is washed with 300% of water at 25° C. during 5 minutes, and is then fat-liquored in a fresh bath with 3% of fat-liquor (sulphited fish-oil) in 250% of water at 50° C. during 60 minutes. Finally the leather is washed with 300% of water at 35° C. during 5 minutes, then the bath is drained off, the leather discharged, dried hanging and mechanically finished in the usual way. It is dyed in a regular brown shade of good penetration.

EXAMPLE 2

The procedure of Example 1 is repeated, with the difference that instead of Product (1) there is employed the same amount of Product (2) according to Example 2 of German Patent Application P 42 27 778.7, which is 19.82% aqueous solution of the sodium salt of an acrylic acid (7)/α-hydroxyacrylic acid (3) copolymer with $\overline{M}_N$=1,58.10$^4$ and $\overline{M}_W$=1.48.10$^5$).

EXAMPLE 3

The procedure described in Example 1 is repeated, with the difference that instead of Product (1) there is employed the same amount of Product (3), according to Example 3 of German Patent Application P 42 27 778.7, which is a 19.92% aqueous solution of the sodium salt of an acrylic acid (7)/-α -hydroxyacrylic acid (3) copolymer with $\overline{M}_N$=1.3.10$^4$, $\overline{M}_W$=8.8.10$^4$).

EXAMPLE 4

The procedure described in Example 1 is repeated, with the difference that instead of Product (1) there is employed the same amount of Product (4) according to Example 4 of German Patent Application P 42 27 778.7, which is a 20.46% aqueous solution of the sodium salt of an acrylic acid (9)/-α-hydroxyacrylic acid (1) copolymer with $\overline{M}_N$=8.6.10$^3$, $\overline{M}_W$=9.3.10$^4$).

EXAMPLE 5

The procedure described in Example 1 is repeated, with the difference that instead of Product (1) there is employed the same amount of Product (5) according to Example 5 of German Patent Application P 42 27 778.7, which is a 20.57% aqueous solution of the sodium salt of an acrylic acid (8)/α-hydroxyacrylic acid (2) copolymer with $\overline{M}_N$=1.3.10$^4$, $\overline{M}_W$=1.15.10$^5$).

EXAMPLE 6

The procedure described in Example 1 is repeated, with the difference that after 15 minutes of dyeing the leather is treated in the same bath with the following additions in the indicated sequence:

5% of the phosphoric acid ester according to Example 1 of EP 87 799 B1 (diluted 1:3 with water), during 60 minutes at 50° C., 4% of mimosa extract (WIBULL) during 30 minutes at 50° C., 5% of the phosphoric acid ester according to Example 1 of EP 87 779 B1 (diluted 1:3 with water), during 60 minutes at 50° C., 1% of formic acid (diluted 1:10 with water), during 30 minutes at 20° C. up to pH 3.8;

then the bath is drained-off and in a fresh bath of 100% of water at 30° C. the leather is treated with 1% of Product (1) according to Example 1 of German Patent Application P 42 27 778.7 during 30 minutes, after which there are added 2.5% of chromium sulphate (of 33% basicity) and drumming is continued for 60 minutes at 30° C.; then the bath is drained-off and the leather is washed twice with 300% of water at 20° C. each time. Now the bath is drained-off and the leather is discharged and dried hanging overnight, then it is set out and vacuum-dried during 2.5 minutes at 80° C. The so obtained leather is regularly dyed in brown with good penetration and displays in comparison to the blind sample [i.e. produced in the same way but without Product (1)] an improved water resistance (BALLY penetrometer test).

Analogously as the Product (1) of Example 1 of German Patent Application P 42 27 778.7 there are employed in the above Example 6 the same amounts of Products (2), (3), (4) or (5) of Examples 2, 3, 4 resp. 5 of German Patent Application P 42 27 778.7.

We claim:

1. A process for the re-tanning of tanned leather or pelt, wherein the tanned leather or pelt is re-tanned with (A) a polymeric carboxylic acid, containing α-hydroxyacrylic units as constituent units of the polymer, optionally in salt form, and where the tanned leather or pelt is mineral tanned, it has also been neutralized prior to the re-tanning step, with the proviso that said re-tanning polymer (A) is not employed together with mineral tanning agents, immediately after a mineral tanning, immediately before a mineral re-tanning or after a mineral re-tanning and also not immediately before a mineral after-treatment.

2. A process according to claim 1, wherein polymer (A) is a (co)-polymer comprising α-hydroxyacrylic acid units, optionally in salt form, and optionally non-ionic and/or other anionic comonomer units, optionally in salt form.

3. A process according to claim 1, wherein polymer (A) is a co-poly-α-hydroxyacrylic acid, comprising (meth)-acrylic acid, crotonic acid, itaconic acid, aconitic acid, citraconic acid and/or maleic acid units, stituent units of the polymer, optionally in salt form.

4. A process according to claim 1, wherein polymer (A) is a co-poly-α -hydroxyacrylic acid, optionally in salt form, in which the content of α-hydroxyacrylic acid units, optionally in salt form, is in the range of 5 to 70 mol % referred to the total of the monomeric units in polymer (A).

5. A process according to claim 4, wherein the content in α -hydroxyacrylic acid units, optionally in salt form, in polymer (A) is in the range of 10 to 50 mol % of the total of the monomeric units in polymer (A).

6. A process according to claim 1, wherein the number average molecular weight $\overline{M}_N$ of polymer (A) is in the range of 500 to 100,000, and the weight average molecular weight $\overline{M}_W$ of (A) is in the range of 1000 to 500,000.

7. A process according to claim 1, wherein re-tanning is carried out with polymer (A) and with another non-mineral re-tanning agent.

8. A process according to claim 1, wherein the re-tanned leather or pelt is dyed with a hydrosoluble anionic or nonionic dye, effective for the dyeing of leather or pelt from an aqueous medium.

9. A process according to claim 1 comprising an additional step, wherein the leather or pelt is fatted before, simultaneously with or/and after the treatment with polymer (A).

10. A process according to claim 8, wherein the leather or pelt is fatted before and/or after the dyeing of the leather or pelt.

11. A process according to claim 8, wherein after dyeing, the leather or pelt is treated with products effective for the improvement of the water resistance of the leather or pelt.

12. A leather or pelt re-tanned according to the process of claim 1.

* * * * *